United States Patent [19]

Emmie

[11] 4,130,272

[45] Dec. 19, 1978

[54] FLEXIBLE PICKET FENCE

[76] Inventor: George W. Emmie, 4141 Nicholas Dr., Sterling Heights, Mich. 48077

[21] Appl. No.: 835,666

[22] Filed: Sep. 22, 1977

[51] Int. Cl.[2] ..... E04H 17/14

[52] U.S. Cl. ..... 256/22; 256/26

[58] Field of Search ..... 256/19, 22, 26, 25, 256/24, 34; 52/DIG. 3

[56] References Cited

U.S. PATENT DOCUMENTS

| | | | |
|---|---|---|---|
| 466,654 | 1/1892 | Clapp | 256/22 |
| 2,766,967 | 10/1956 | Roberts | 256/22 |
| 2,842,776 | 7/1958 | Zakin | 256/25 X |
| 3,484,081 | 12/1969 | Rowan | 256/22 |
| 3,604,685 | 9/1971 | Pokryfki | 256/26 X |
| 3,711,066 | 1/1973 | Niemiec | 256/19 |

FOREIGN PATENT DOCUMENTS

| | | | |
|---|---|---|---|
| 57885 | 8/1940 | Denmark | 256/22 |

*Primary Examiner*—Andrew V. Kundrat

*Attorney, Agent, or Firm*—Basile and Weintraub

[57] ABSTRACT

A picket fence comprising a plurality of parallel and laterally spaced metal pickets which are interconnected by a plurality of parallel pairs of stringers. The stringers are made from a metal material and have opposite ends shaped in a tubular configuration which are received in mating recesses on adjacent, parallel pickets such that the pickets are rotatable about the tubular configurations of the stringers whereby the pickets and their associated stringers are movable with respect to each other in such a manner that the pickets may be disposed along a curved path.

4 Claims, 11 Drawing Figures

Fig-2
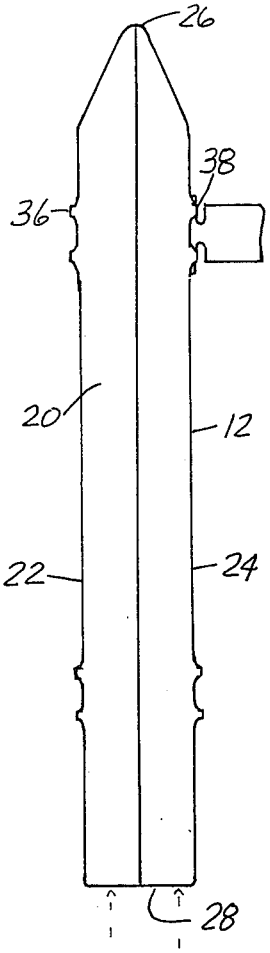
Fig-3
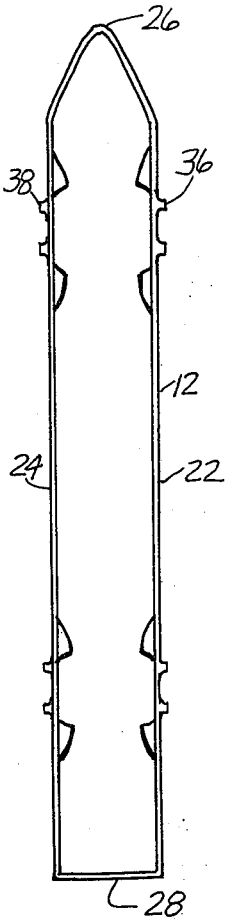
Fig-4
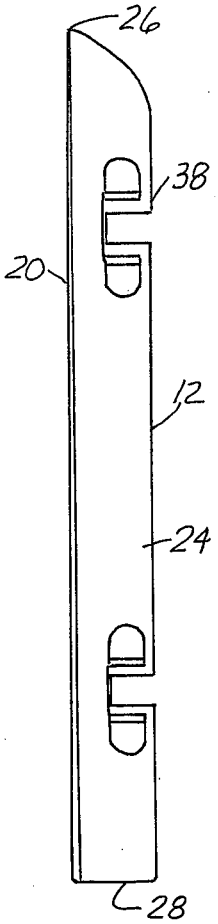
Fig-11
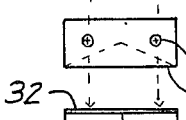
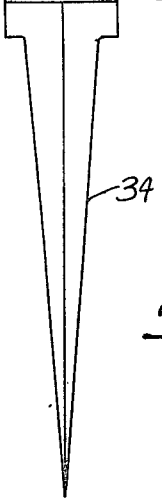
Fig-10
Fig-5
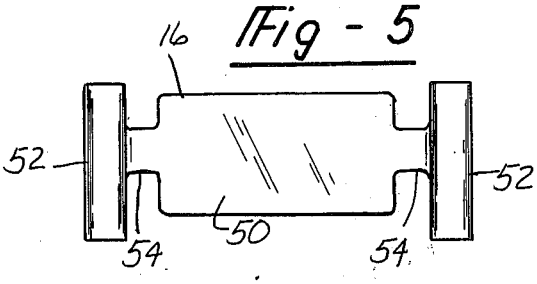
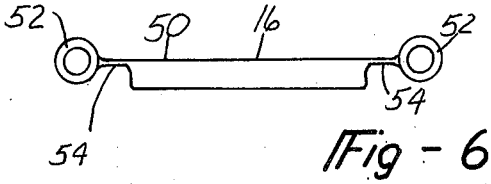
Fig-6

FLEXIBLE PICKET FENCE

BACKGROUND OF THE INVENTION

I. Field of the Invention

The present invention relates generally to fences and, more particularly, to a new and novel picket fence fabricated from a metal material wherein the picket fence may be positioned along a curved path.

II. Description of the Prior Art

Heretofore, numerous designs have been suggested for the fabrication of fences and, in particular, for the fabrication of picket-type fences. Examples of fences fabricated from a metal material are disclosed in U.S. Letters Pat. Nos. 1,668,651 and 2,520,314. Each of these patents discloses a picket fence fabricated from a metal material or the like, and each represents a successful approach for the fabrication of such fences. Both fences have drawbacks in that the adjacent pickets are not movable with respect to each other to permit the fences to follow a curved path.

In U.S. Letters Pat. Nos. 692,461 and 2,919,112 relative movement between adjacent pickets of a picket fence is achieved; however, the relative movement is in an up-and-down relationship with respect to one another. In axes which are parallel to each other, the pickets may be tilted from the vertical; that is, parallel pickets may be inclined with respect to the parallel axes of the stringers.

In U.S. Letters Pat. Nos. 466,654; 1,167,689; and 899,605 there is suggested the possibility of fabricating metal fences from elements which are movable with respect to each other in such a manner that the fence may follow a curved path. None of these patents suggest the novel and unique method in which applicant proposes for the construction of a metal picket fence wherein each picket is movable with respect to adjacent pickets because of a novel, pivotal engagement of the picket with its associated stringers such that the picket fence may follow a curved path.

PRIOR ART STATEMENT

In the opinion of the applicant the above-identified United States Letters Patents represent the most relevant prior art of which the applicant is aware.

SUMMARY OF THE INVENTION

The present invention, which will be described subsequently in greater detail, comprises a flexible picket fence comprising a plurality of parallel, laterally spaced pickets, each fabricated from a metal material, and a plurality of parallel pairs of stringers interconnecting the pickets, each of the stringers being fabricated from a metal material. Each stringer has opposite ends which are pivotally attached to adjacent, laterally spaced pickets such that the pickets and their associated stringers are movable with respect to each other about an axis which is parallel to the longitudinal axis of the pickets, while maintaining the pickets in said parallel relationship, and for permitting the pickets to be positioned along a curved path.

It is therefore an object of the present invention to provide a picket fence structure which may be easily erected and adapted to follow a curved path.

It is a further object of the present invention to provide a novel, flexible picket fence having a new and unique means for interconnecting the parallel pickets such that the parallel pickets may be moved relative to each other so as to laterally offset each adjacent picket, as desired.

it is a further object of the present invention to provide a new and unique means for mounting the pickets in an upright position by means of a novel stake arrangement carried by selected pickets along the length of a picket fence.

It is a further object of the present invention to provide a new and improved picket fence which is of a simple design and, thus, easy and inexpensive to fabricate.

Other objects, advantages and applications of the present invention will become apparent to those skilled in the art of flexible picket fences when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 2 is a front elevational view of one of the pickets illustrated in FIG. 1;

FIG. 3 is a rear elevational view of the picket illustrated in FIGS. 1 and 2 of the drawings;

FIG. 4 is a right-end elevational view of the picket illustrated throughout the several views;

FIG. 5 is a front elevational view of one example of a stringer employed to interconnect the several pickets employed in the manufacture of the inventive picket fence;

FIG. 6 is a top elevational view of the stringer illustrated in FIG. 5 of the drawings;

FIG. 10 is a front elevational view of one example of an inventive stake employed for fastening the picket fence into the ground; and FIG. 11 is a top elevational view thereof.

DESCRIPTION OF THE PREFERRED EMBODIMENT

Figure 1:
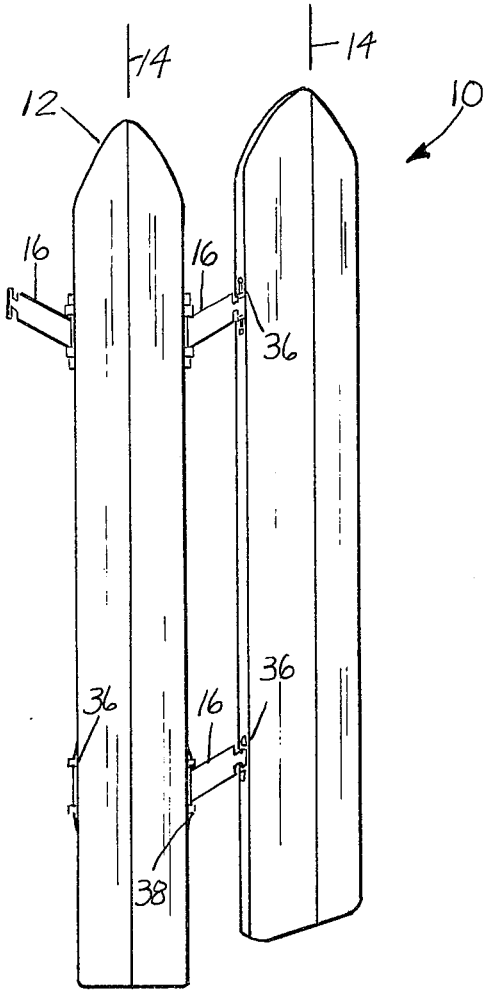
FIG. 1 is a perspective view of a pair of pickets forming a portion of a picket fence which are fabricated in accordance with the principles of the present invention.

Referring now to the drawings and, in particular, to FIG. 1 wherein there is illustrated one example of the present invention in the form of a picket fence 10 which comprises a plurality of laterally spaced pickets 12 which are each disposed along longitudinal axes 14 which are parallel to one another. Vertically disposed pickets 12 are connected by pairs of stringers 16 which are laterally spaced from one another and disposed along parallel axes which, in turn, are perpendicular to the pickets 12 such that when the pickets are disposed in a side-by-side arrangement and interconnected by the stringers 16, the pickets 12 and the stringers 16 take on the appearance of the conventional picket fence. The unique manner in which the pickets 12 are interconnected by means of the stringers 16 will be described in greater detail hereinafter.

Referring now to FIGS. 2, 3, 4, 7, 8 and 9 for a more detailed description of each of the pickets 12, it can be seen that each picket 12 is formed from a metal stamping having a front surface 20 which is flared rearwardly toward sides 22 and 24 which, in turn, are tapered at their upper ends and feathered into the top of the picket to define an apex 26 at the top thereof. The bottom wall 28 of each picket 12 has a pair of apertures (not shown) which are adapted to mate with a pair of apertures 30 formed on the top plate 32 of a stake 34. The stake 34 is adapted to be attached to selected numbers of the pickets 12 such that every half-dozen pickets is provided with a stake 34 so that the picket 12 may be driven into the ground a sufficient distance to provide a simple means for maintaining the fence 10 in an upright position.

Figure 7:
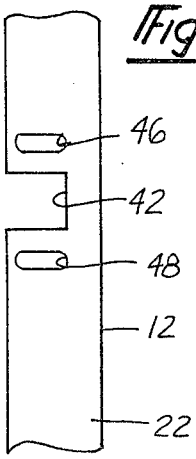
FIG. 7 is an enlarged, fragmentary view of a picket illustrating an initial step in fabricating the same.

Each side wall 22 and 24 is provided with upper and lower connection joints 36 and 38. As can best be seen in FIGS. 7, 8 and 9, each connection joint, in turn, has upper and lower circular recesses 40 and 41 which are separated by an elongated slot 42 and a pair of circular ridges 44, all of which function in a manner to provide for the connection of adjacent pickets 12, as will be described hereinafter. The connection joints 36 and 38 are formed by first stamping the sides 22 and 24 with the slot 42 and upper and lower slots 46 and 48, as shown in FIG. 7. The sections of the sides 22 and 24 above and below the slots 46 and 48 are respectively deformed to define circular recesses 40 and 41 while the material between the slots 42, 46 and 48 is bent into the circular configuration shown at 44.

Figure 8:
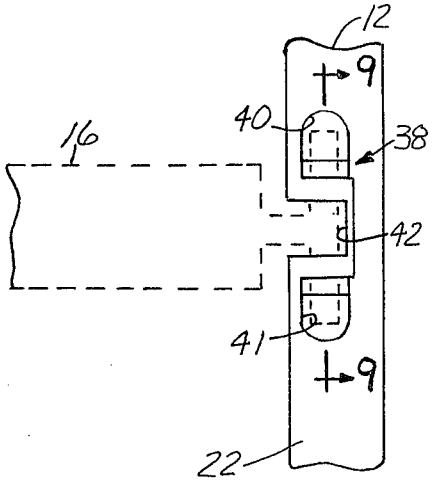
FIG. 8 is an enlarged, fragmentary, end elevational view of a picket illustrating a stringer in phantom lines in order to illustrate the inventive and novel means interconnecting a stringer and pickets.
Figure 9:
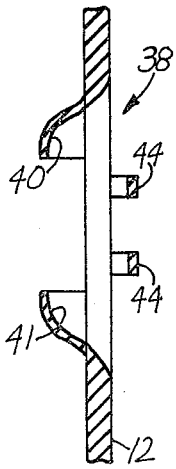
FIG. 9 is a fragmentary, cross-sectional view taken along Line 9—9 of FIG. 8.

Referring now to FIGS. 5 and 6, it can be seen that each of the stringers 16 comprises an elongated midsection 50 which is connected at opposite ends to tubular members 52. The connection is preferably made by a projecting flange 54. The tubular ends 52 are shaped to be received by and mate with the connecting joints 36 and 38. As can be seen in FIG. 8 of the drawings, one end of the tubular end section 52 is inserted through the ring 44 into the upper recess 40 until the lower end of the tubular end section clears the slot 42 and may be inserted through the lower ring 44 and received by the matingly shaped lower recess 41. In this position it can be seen that the stringer tubular end 52 is securely received within the connecting joint 36 (or 38) of the picket 12, and there can be relative pivotal movement between the stringer 16 and the picket 12 such that the picket 12 rotates about an axis defined by the tubular member 52, which axis is parallel to the longitudinal axis of the picket 12. Similar stringers 16 are inserted in both the upper and lower connection joints 36 and 38 of each picket 12 and on each side 22 and 24 thereof so that adjacent pickets 12 may be interconnected in the aforementioned manner.

While applicant has disclosed his inventive fence as being fabricated from a metal material, such as stainless steel or the like, it should be understood by those skilled in the art that other suitable materials may be utilized in the manufacture of applicant's inventive fence, including materials such as plastic and the like.

It can thus be seen that because of the novel means for the interconnection of adjacent pickets 12 by means of the stringers 16, each adjacent picket 12 may be laterally shifted with respect to its adjacent picket such that the picket fence may follow any tortuous path desired.

It can thus be seen that the present invention has provided a new and improved picket fence fabricated from metal materials and one which may be easily and simply installed to follow any desired tortuous path and one which is of an extremely simple design and, thus, inexpensive to manufacture.

Although only one form of applicant's invention has been disclosed, it should be apparent to those skilled in the art of flexible picket fences that other forms of applicant's invention may be had, all coming within the spirit of the invention and scope of the appended claims.

What is claimed is as follows:

1. A flexible picket fence comprising:

a plurality of parallel, laterally spaced pickets; and a plurality of parallel pairs of stringers interconnecting said pickets, each stringer having opposite ends pivotally attached to adjacent, laterally spaced pickets such that said pickets and their associated stringers are movable with respect to each other about an axis parallel to the longitudinal axis of said pickets while maintaining said pickets in said parallel relationship and permitting said pickets to be disposed along a curved path, each of said pickets having a front wall and side walls connected thereto, each side wall having longitudinally spaced connecting joints, each of said connecting joints having a slot dividing the joint into upper and lower recesses including circular rings adjacent to said slot between said slot and the upper and lower recesses, said recesses having a circular configuration, each of said stringers having tubular end sections, said tubular end sections being matingly received by said picket recesses to permit pivotal movement between said pickets and said stringers.

2. The flexible picket fence defined in claim 1 further comprising:

a plurality of stake members;

means for connecting said stake members to selected numbers of said pickets at the base thereof for permitting said selected number of pickets to be affixed to the ground.

3. The flexible picket fence defined in claim 1 wherein each of said stringers is fabricated from a metal material.

4. The flexible picket fence defined in claim 1 wherein each of said pickets is fabricated from a metal material.

* * * * *